US007335406B2

(12) United States Patent
Hubbs

(10) Patent No.: US 7,335,406 B2
(45) Date of Patent: Feb. 26, 2008

(54) SURFACES FOR SUPPORTING ARTIFICIAL PLAYING SURFACES

(75) Inventor: Jonathan W. Hubbs, Phoenix, AZ (US)

(73) Assignee: Stabilizer Solutions, Inc., Phoenix, AZ (US)

( * ) Notice: Subject to any disclaimer, the term of this patent is extended or adjusted under 35 U.S.C. 154(b) by 0 days.

(21) Appl. No.: 10/739,026

(22) Filed: Dec. 16, 2003

(65) Prior Publication Data

US 2005/0129904 A1 Jun. 16, 2005

(51) Int. Cl.
*E01C 13/06* (2006.01)
*E01C 13/08* (2006.01)
*E01C 13/00* (2006.01)

(52) U.S. Cl. ..... 428/17; 47/1.01 F

(58) Field of Classification Search ..... 47/1.01 F, 47/1.01 R; 428/87, 97, 17; 427/17
See application file for complete search history.

(56) References Cited

U.S. PATENT DOCUMENTS 3,995,079 A 11/1976 Haas
4,396,653 A * 8/1983 Tomarin ..... 428/17
4,735,825 A * 4/1988 Friedrich ..... 427/202
4,827,665 A * 5/1989 Hubbs et al. ..... 47/9
5,014,462 A * 5/1991 Malmgren et al. ..... 47/1.01 R
5,041,320 A * 8/1991 Meredith et al. ..... 428/87
5,404,671 A * 4/1995 Farrow et al. ..... 47/1.01 R
5,746,546 A * 5/1998 Hubbs et al. ..... 405/263
6,029,397 A 2/2000 Motz et al.
6,042,305 A 3/2000 Novich et al.
6,173,528 B1 1/2001 Motz et al.
6,216,389 B1 4/2001 Motz et al.
6,221,445 B1 4/2001 Jones

FOREIGN PATENT DOCUMENTS

GB 2306494 A * 5/1997
JP 7-207614 * 8/1995

OTHER PUBLICATIONS

Anonymous. 1998. Merriam-Webster's Collegiate Dictionary, 10th ed. p. 660.*

* cited by examiner

*Primary Examiner*—Jeffrey L. Gellner
(74) *Attorney, Agent, or Firm*—David E. Rogers; Squire, Sanders & Dempsey L.L.P.

(57) ABSTRACT

Surfaces and methods for producing surfaces that may support an artificial playing surface are disclosed herein. An example of a surface according to the invention includes a first layer with soil and a plurality of fibers, and a second layer with soil and an organic binder. At least a portion of the second layer is above the first layer. Both layers should be water permeable to some degree. The organic binder may include material from plants of one or more of the plantago family (such as dried and ground plantago husk) and/or guar family.

46 Claims, 2 Drawing Sheets

SURFACES FOR SUPPORTING ARTIFICIAL PLAYING SURFACES

DESCRIPTION OF THE INVENTION

1. Field of the Invention

The present invention relates to surfaces for supporting activity and systems and methods for supporting artificial playing surfaces.

2. Background of the Invention

As used herein and throughout, the terms in quotations below are defined as follows:

a. The term "soil" refers to any mixture of particulate surface material of the earth, whether or not it contains organic matter, and includes sand, silt, clay and crushed rock such as decomposed granite, or any combination thereof.

b. The term "sand" refers to any granular material formed by the disintegration of rocks to form particles smaller than gravel but coarser than silt. Sand may or may not include organic matter.

c. The term "silt" refers to any unconsolidated sedimentary material with rock particles usually 1/20 millimeter or less in diameter, and being generally smaller than sand but coarser than clay. Silt may or may not include organic matter.

d. The term "clay" refers to any (1) inorganic earth surface material that is plastic when moist but hard when fired and that is comprised primarily of hydrous aluminum silicates and/or other minerals, or (2) substance having the properties of clay. Clay includes dry and wet substances and may or may not include organic matter.

e. The term "organic binder" refers to any organic matter that tends to bind soil particles together when mixed with the soil particles, wetted and subsequently dried.

f. The term "fibers" refers to any fibers, ribbons or strips of material used to add mechanical strength to soil.

g. The term "artificial playing surface" or "artificial turf" means any surface manufactured from artificial material(s) and includes artificial grass.

An artificial playing surface, such as one including artificial turf, may be used in place of natural turf, or to replace natural turf, as a surface for events or activities that may be held on athletic fields or elsewhere. In the prior art replacement process, the natural turf is removed as usually are any soil or layers below the natural turf down to a drainage layer. The drainage layer usually contains gravel and is typically not as smooth as desired for supporting artificial turf. To provide a smooth surface above the drainage layer to support the artificial turf, it has been known to provide a layer of sand with plastic fibers incorporated therein placed on top of the drainage layer. The layer of sand and fibers is smoothed and leveled by raking, and the artificial turf is placed on top of this layer. Adding fibers to the sand layer, however, makes more difficult the smoothing and leveling process.

A need exists for systems and methods for providing a surface for supporting artificial turf that overcome the problems of the prior art approach.

SUMMARY OF THE INVENTION

Surfaces and methods for making surfaces that can support artificial playing surfaces are disclosed herein. A surface according to the invention may include a first layer including soil and a plurality of fibers and a second layer including soil and an organic binder, wherein at least a portion of the second layer is above the first layer. This surface optionally includes artificial turf wherein at least a portion of the artificial turf is above the second layer.

A method of providing support for an artificial playing surface includes providing a first layer comprising a plurality of fibers in a first soil, and providing a second layer comprising organic binder in a second soil. The first layer is placed on an existing surface (such as a drainage surface) and then at least a portion of the second layer is positioned on the first layer. Optionally, an artificial turf is applied at least partially on the second layer.

Objects and advantages of the invention will be set forth in part in the description which follows, and others will be obvious from the description, or may be learned by practice of the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present exemplary embodiments of the invention, examples of which are illustrated in the accompanying drawings. Wherever possible, the same reference numbers will be used throughout the drawings to refer to the same or like components.

Figure 1:
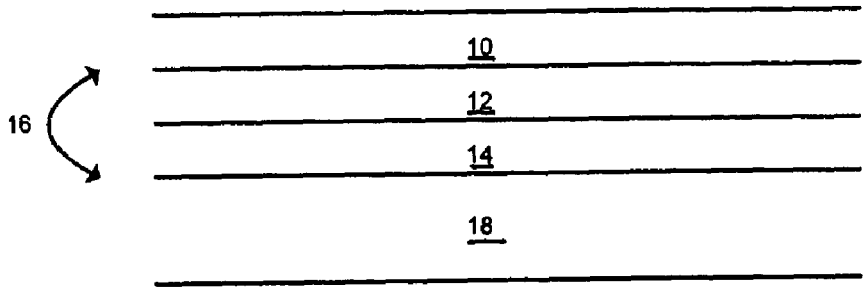
FIG. 1 is a simplified cross-sectional representation showing a surface in accordance with the present invention.

Referring to FIG. 1, a simplified cross-sectional view shows a surface 16 for supporting for an artificial playing surface 10. The artificial playing surface 10 itself may comprise multiple layers including an upper surface of artificial fibers that resemble grass, and can be any type of artificial surface used for any purpose. Surface 16 comprises at least two layers, a first soil layer 14 and a second soil layer 12, both of which may be water permeable and which are preferably supported by an optional drainage layer 18. First layer 14 includes a mixture of soil, such as sand, and fibers, such as plastic strips. The preferred first layer 14 preferably includes a soil that is primarily or entirely sand with between 0.2% and 0.4% fibers by weight. The preferred fiber is Turfgrids® plastic strip fibers supplied by Stabilizer Solutions, Inc. of Phoenix, Ariz. and having the following properties:

Turfgrids ® Product Specifications

| Property | Test Method | Requirement |
|---|---|---|
| Polypropylene | ASTM D4101 Group 1/Class 1/Grade 2 | 99% Minimum |
| Moisture Absorption | * | Nil |
| Fiber Length | Measured | ½ to 2 inch minimum |
| Color | * | Green, Manila, Black |

-continued

Turfgrids ® Product Specifications

| Property | Test Method | Requirement |
|---|---|---|
| Specific Gravity | ASTM D792 | 0.91 gm/cm3 |
| Tensile Strength | ASTM D2256 | 40,000 psi, minimum |
| Tensile Elongation | ASTM 2256 | 20%, maximum |
| Young's Modulus | ASTM D2101 | 600,000 psi, minimum |

Second layer 12 includes soil, and may be primarily or entirely sand, and an organic binder, which may include plant parts from one or more of plants of the plantago family and the guar family, and is preferably about 0.4 to 2% (most preferably about 0.4 to 1%) by weight psyllium, i.e., an organic binder containing about 90% or greater dried and ground plantago husk, and most preferably 95% or more dried and ground plantago husk. U.S. Pat. No. 4,827,665, to Jonathan Hubbs and James Hubbs and incorporated herein by reference, describes a method of conditioning soil with an organic soil conditioner, such as an organic binder comprising one or more plant parts of the plantago family. Those skilled in the art understand that similar materials, such as plant parts of the guar family, may be similarly employed. Alternatively, psyllium coated or mixed with wax and/or polymer may be used.

Figure 3:
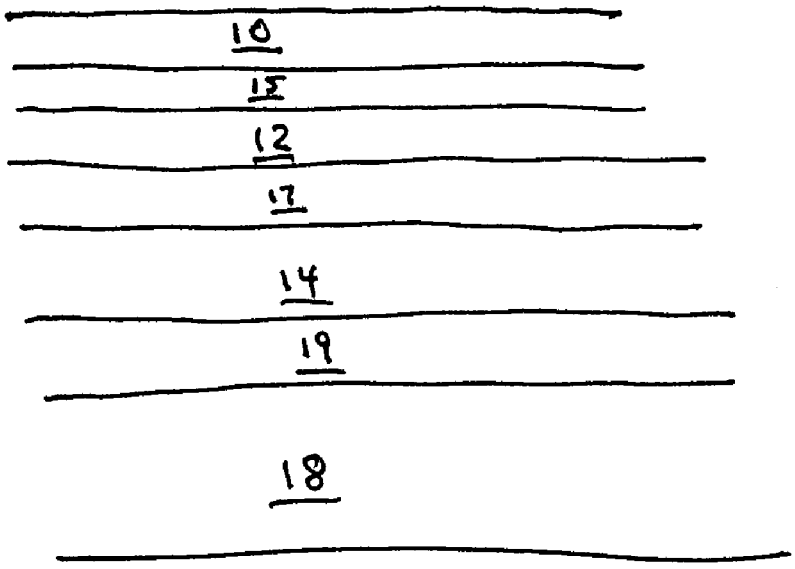
FIG. 3 is a generalized schematic of an alternate surface in accordance with the present invention.

In variations, as shown in FIG. 3, one or more layers of soil, such as layers 15 and/or 17, and/or 19, may be dispersed between one or more of artificial playing surface 10 and second layer 12, and/or second layer 12 and first layer 14. Furthermore, there may be one or more layers of material between drainage layer 18 (if present) and first layer 14.

Figure 2:
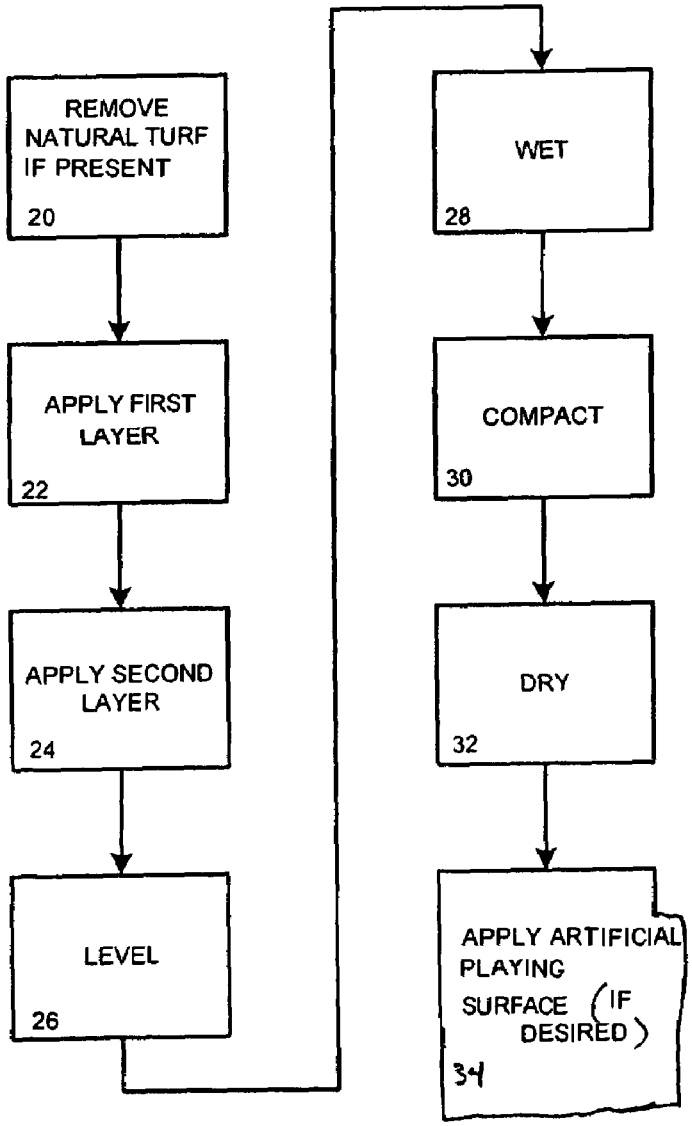
FIG. 2 is a flowchart representing a method of providing a surface that may be used to support an artificial playing surface in accordance with the present invention.

Referring to FIG. 2, a flowchart represents a preferred method for replacing a natural playing surface with an artificial playing surface.

In step 20, a natural playing surface, which comprises an upper surface of a natural playing layer, such as natural grass, may be removed. In this step, soil below the natural playing layer may also be removed down to a drainage layer, wherein the drainage layer 18 may include gravel or gravel and sand. Drainage pipes may also be positioned in the drainage layer 18, which is usually about 6-8" thick. In a variation of step 20, if there is no natural playing layer to be removed, just soil above the drainage layer may be removed, or, for a new field, only the drainage layer may be present in which case no soil layers or turf are removed. As those skilled in the art appreciate, any suitable technique may be employed to remove the natural playing layer and/or soil.

In step 22, first layer 14 is dispersed onto layer 18. First layer 14 is prepared by mixing soil, which may be primarily or entirely sand, with a plurality of fibers, such as plastic strips. Any mixing technique may be used. For example, the fibers may be mixed into the soil of first layer 14 while the soil of layer 14 is on layer 18. Alternatively, the fibers and the soil of first layer 14 may be premixed by any suitable techniques, such as by being mixed in a mixing apparatus such as a pug mill. After layer 14 is dispersed, it may optionally be wetted, dried, leveled and/or compacted to attain any desired condition, which may include one or more of a desired thickness and levelness, while still permitting first layer 14 to be water permeable. The preferred thickness of layer 14 is between 2" and 10" and most preferably about 5", and layer 14 preferably has a substantially uniform thickness. Optionally, there may be one or more layers of material between layer 18 and layer 14, in which case layer 14 would be positioned at least partially on a layer between layer 14 and layer 18.

In step 24, second layer 12 is dispersed onto layer 14. Layer 12 is prepared by mixing soil, which may be partly or entirely sand, with an organic binder, which may be one or more plant parts of one or more of the plantago family and/or guar family, or may be psyllium mixed with wax and/or polymer. Any mixing technique may be used. For example, the organic binder may be mixed into the soil of second layer 12 while the soil of second layer 12 is on first layer 14. Alternatively, the organic binder and the soil of second layer 12 may be premixed by hand or in a mixing apparatus, and thereafter dispersed on first layer 14. The preparation of layer 12, if it contains material such as plantago and/or guar as the organic binder or part of the organic binder, preferably includes wetting, drying and compacting second layer 12, as shown in optional steps 26-32, to attain one or more of a desired thickness, levelness and firmness while still permitting second layer 12 to be water permeable. In a preferred embodiment, second layer 12 is between ½" and 6" thick, and is preferably about 2" thick, and has a substantially uniform thickness. Optionally, there may be one or more layers of material between layer 12 and layer 14, in which case layer 12 would be positioned at least partially on a layer between layer 14 and layer 12.

In step 34, artificial turf is applied using any suitable technique. In one method, the artificial turf is rolled onto layer 12 in strips about 12 feet wide. Optionally, a rubber pad is first placed on layer 12 to provide cushioning. Once rolled out, the artificial turf may be attached to a border surrounding the field and the strips have seams that are heat sealed together. One or more layers of material may be positioned between artificial playing surface 10 and second layer 12.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A surface comprising:

a first layer including a first soil and a plurality of fibers within a range of 0.2% to 0.4% fibers by weight;

a second layer including a second soil and an organic binder within a range of 0.4% to 2% by weight, wherein a portion of the second layer is above the first layer; and wherein the first layer does not include organic binder within the range of 0.4% to 2% by weight and the second layer does not include fibers within the range of 0.2% to 0.4% by weight.

2. The surface of claim 1 wherein the portion comprises a majority of the second layer.

3. The surface of claim 1 wherein the portion comprises all of the second layer.

4. The surface of claim 1 wherein the organic binder includes psyllium mixed with wax and polymer.

5. The surface of claim 1 wherein there is an additional layer of material above the first layer.

6. The surface of claim 1 wherein the first layer is water permeable.

7. The surface of claim 1 wherein the first soil includes sand.

8. The surface of claim 1 wherein the plurality of fibers includes inorganic fibers.

9. The surface of claim 1 wherein the second layer is water permeable.

10. The surface of claim 1 wherein the second soil includes sand.

11. The surface of claim 1 wherein the organic binder includes one or more of plantago and guar.

12. The surface of claim 1 wherein the first soil and the second soil are comprised of the same material.

13. The surface of claim 1 wherein the organic binder comprises 90% or more plantago husk.

14. The surface of claim 1 wherein the first layer is between 2" and 10" thick.

15. The surface of claim 14 wherein the first layer is 5" thick.

16. The surface of claim 1 wherein the second layer is between ½" and 6" thick.

17. The surface of claim 16 wherein the second layer is 2" thick.

18. The surface of claim 1 wherein there is an additional layer of material between the first layer and the second layer.

19. The surface of claim 13 wherein the organic binder comprises 95% or more plantago husk.

20. The surface of claim 1 wherein the second layer comprises 0.4% to 1% by weight of organic binder.

21. The surface of claim 1 wherein the fibers are plastic strips.

22. The surface of claim 21 wherein the plastic strips are comprised of polypropylene.

23. The surface of claim 22 wherein the fibers are between ½" and 2" long.

24. A surface comprising:

a first layer including a first soil and a plurality of fibers within a range of 0.2% to 0.4% fibers by weight;

a second layer including a second soil and an organic binder within a range of 0.4% to 2% by weight, wherein a portion of the second layer is above the first layer; and an artificial playing surface including a portion that is above the second layer;

wherein the first layer does not include organic binder within the range of 0.4% to 2% by weight and the second layer does not include fibers within the range of 0.2% to 0.4% by weight.

25. The surface of claim 24 wherein the portion of the second layer comprises a majority of the second layer.

26. The surface of claim 24 wherein the portion of the second layer comprises all of the second layer.

27. The surface of claim 24 wherein the portion of the artificial playing surface comprises a majority of the artificial playing surface.

28. The surface of claim 24 wherein the portion of the artificial playing surface comprises all of the playing surface.

29. The surface of claim 24 wherein there is an additional layer of material positioned at least partially between the first layer and the second layer.

30. The surface of claim 24 wherein the first layer is water permeable.

31. The surface of claim 24 wherein the first soil includes sand.

32. The surface of claim 24 wherein the plurality of fibers includes inorganic fibers.

33. The surface of claim 24 wherein the second layer is water permeable.

34. The surface of claim 24 wherein the second soil includes sand.

35. The surface of claim 24 wherein the first soil and the second soil are comprised of the same material.

36. The surface of claim 24 wherein the organic binder includes one or more of plantago and guar.

37. The surface of claim 24 wherein the organic binder comprises 90% or more plantago husk.

38. The surface of claim 24 wherein the organic binder includes psyllium mixed with wax and polymer.

39. The surface of claim 24 wherein there is an additional layer of material above the first layer.

40. The surface of claim 24 wherein there is an additional layer of material between the first layer and the second layer.

41. The surface of claim 24 wherein the organic binder comprises 95% or more plantago husk.

42. The surface of claim 24 wherein the second layer comprises 0.4% to 1% by weight of organic binder.

43. The surface of claim 24 wherein the fibers are plastic strips.

44. The surface of claim 43 wherein the plastic strips are comprised of polypropylene.

45. The surface of claim 44 wherein the fibers are between ½" and 2" long.

46. The surface of claim 24 wherein there are one or more layers of material positioned between the second layer and the artificial playing surface.

* * * * *